US008622212B2

(12) United States Patent
Kinskey et al.

(10) Patent No.: US 8,622,212 B2
(45) Date of Patent: Jan. 7, 2014

(54) TOOL HOLDER

(75) Inventors: Terrence P. Kinskey, Alpharetta, GA (US); Matthew G. Williams, Lighthouse Point, FL (US)

(73) Assignee: LF Centennial Ltd., Tortola (VG)

( * ) Notice: Subject to any disclaimer, the term of this patent is extended or adjusted under 35 U.S.C. 154(b) by 0 days.

(21) Appl. No.: 13/543,314

(22) Filed: Jul. 6, 2012

(65) Prior Publication Data

US 2013/0008813 A1 Jan. 10, 2013

Related U.S. Application Data

(60) Provisional application No. 61/505,697, filed on Jul. 8, 2011.

(51) Int. Cl.
*B65D 85/28* (2006.01)

(52) U.S. Cl.
USPC ..... 206/372; 383/39

(58) Field of Classification Search
USPC ..... 206/372, 373, 374, 375, 376, 377, 378, 206/379; 383/38, 39, 40
See application file for complete search history.

(56) References Cited

U.S. PATENT DOCUMENTS

| | | | | | |
|---|---|---|---|---|---|
| 4,773,535 | A * | 9/1988 | Cook | 206/373 |
| 4,953,765 | A * | 9/1990 | Little et al. | 224/583 |
| 4,993,551 | A * | 2/1991 | Lindsay | 206/373 |
| 5,174,447 | A * | 12/1992 | Fleming | 206/373 |
| 5,427,239 | A * | 6/1995 | Hunt | 206/372 |
| D383,302 | S | 9/1997 | Broussard | |
| D396,912 | S | 8/1998 | Maire et al. | |
| D417,079 | S | 11/1999 | Heltzel | |
| 6,209,734 | B1 * | 4/2001 | Wang | 211/87.01 |
| 6,315,310 | B1 * | 11/2001 | Hurt | 280/79.5 |
| 6,536,590 | B1 * | 3/2003 | Godshaw et al. | 206/373 |
| D474,022 | S | 5/2003 | Leighton | |
| 6,571,998 | B2 | 6/2003 | Godshaw et al. | |
| D530,917 | S | 10/2006 | Conforti | |
| 7,311,200 | B2 | 12/2007 | Godshaw et al. | |
| D564,219 | S | 3/2008 | Bagus | |
| D613,507 | S | 4/2010 | Brouard | |
| D635,769 | S | 4/2011 | Sosnovsky | |
| 7,950,509 | B2 * | 5/2011 | Redzisz | 190/111 |
| 2005/0189388 | A1 | 9/2005 | Godshaw et al. | |
| 2006/0006619 | A1 * | 1/2006 | Guirlinger | 280/47.26 |
| 2006/0207902 | A1 * | 9/2006 | Frye et al. | 206/373 |
| 2009/0301912 | A1 * | 12/2009 | Cornell | 206/373 |
| 2011/0147428 | A1 * | 6/2011 | Crawford et al. | 224/584 |
| 2012/0247994 | A1 * | 10/2012 | Moreau et al. | 206/373 |

* cited by examiner

*Primary Examiner* — Jacob K Ackun
(74) *Attorney, Agent, or Firm* — Duane Morris LLP; Rodman Steele; Gregory M. Lefkowiz

(57) ABSTRACT

A tool holder is described. The tool holder can include a main panel having a front side and a plurality of sleeves extending from the front side and forming openings. The plurality of sleeves can include a first sleeve component forming peaks and valleys and a second sleeve component coupled to the first sleeve component at coupling points. At least one primary opening can be formed between the main panel and the first sleeve component between adjacent valleys and at least one secondary opening can be formed between the second sleeve component and the first sleeve component between adjacent peaks. A tool can be received through each opening and stored in the tool holder.

9 Claims, 11 Drawing Sheets

TOOL HOLDER

CROSS-REFERENCE TO RELATED APPLICATIONS

This application claims priority to U.S. Provisional Application No. 61/505,697, filed Jul. 8, 2011, the entirety of which is incorporated herein by reference.

FIELD OF THE INVENTION

The present invention relates generally to the field of tools and, more particularly, to holders for tools.

BACKGROUND

Tool holders are known to be useful for workers needing to organize, store or carry a group of tools or transport tools to and from a work site for a specific job. In conventional tool holders and tool bags, tools may be scattered haphazardly in a compartment or an initial placement of the tools will be scattered during transport, so that it may be difficult to quickly locate a specific tool when needed. While conventional tool holders and others of the prior art are useful in some instances, there are still numerous deficiencies and the potential for more useful tool holders and tool holder features.

SUMMARY OF THE INVENTION

A tool holder according to the invention includes a main panel having a front side and a plurality of sleeves extending from the front side and forming openings, such that a tool can be received through each opening. The plurality of sleeves can include a first sleeve component forming a plurality of peaks and valleys and a second sleeve component coupled to the first sleeve component at a plurality of coupling points. At least one primary opening can be formed between the main panel and the first sleeve component between adjacent valleys. At least one secondary opening can be formed between the second sleeve component and the first sleeve component between adjacent peaks. The valleys of the first sleeve component can also be coupled to the front side of the main panel.

The tool holder can also include a pocket extending from a lower end of the front side of the main panel. The pocket can include an inner cavity for receiving a tool supported by the plurality of sleeves. The pocket and the plurality of sleeves can be separated vertically by a distance adapted for receiving and storing a tool.

The coupling points of the tool holder can be positioned at or between adjacent peaks of the first sleeve component. The coupling points can also be positioned at the peaks of the first sleeve component. The coupling points can also include at least two points between adjacent peaks of the first sleeve component.

The tool holder can also include a lower sleeve component extending from the front side of the main panel. The lower sleeve component can be disposed below the plurality of sleeves. The lower sleeve component can include at least one stabilizing opening, and the at least one stabilizing opening can be in substantial vertical alignment with the at least one secondary opening.

The tool holder with the lower sleeve component can also include a pocket extending from a lower end of the front side of the main panel. The pocket can include an inner cavity for receiving a tool supported by the plurality of sleeves. At least a portion of the lower sleeve component can be disposed within the inner cavity of the pocket.

The plurality of sleeves of the tool holder can include materials selected from the group consisting of fabric, plastic, plastic-reinforced fabric, and combinations thereof. An upper edge of the first sleeve component can extend above an upper edge of the second sleeve component, can be flush with an upper edge of the second sleeve component, or can be below an upper edge of the second sleeve component. An upper edge of the lower sleeve component can also be disposed above, flush or below an upper edge of the pocket.

The invention also includes a tool bag having a tool bag body. The tool bag body can include an open topped storage volume formed from a bottom panel and a plurality of side panels. Each of the plurality of side panels can include a front side. The front side of the plurality of side panels can include an inner side of the plurality of side panels and/or an outer side of the plurality of side panels. At least one of the plurality of side panels can include a plurality of sleeves extending from the front side and forming openings, such that a tool can be received through each opening.

The plurality of sleeves can include a first sleeve component forming a plurality of peaks and valleys and a second sleeve component coupled to the first sleeve component at a plurality of coupling points. At least one primary opening can be formed between the side panel and the first sleeve component between adjacent valleys. At least one secondary opening can be formed between the second sleeve component and the first sleeve component between adjacent peaks. The bottom panel and the plurality of sleeves can be separated vertically by a distance adapted for receiving and storing a tool.

The tool bag can also include a pocket extending from a lower end of the front side of the side panel. The pocket can include an inner cavity for receiving a tool. The pocket and the plurality of sleeves can be separated vertically by a distance adapted for receiving and storing a tool. At least a portion of the pocket can also be formed by at least a portion of the bottom wall. The tool bag can also include a lid panel attached to the tool bag body.

These and other features, objects and advantages of the present invention will become more apparent to one skilled in the art from the following description and claims when read in light of the accompanying drawings.

DETAILED DESCRIPTION

Figure 1:
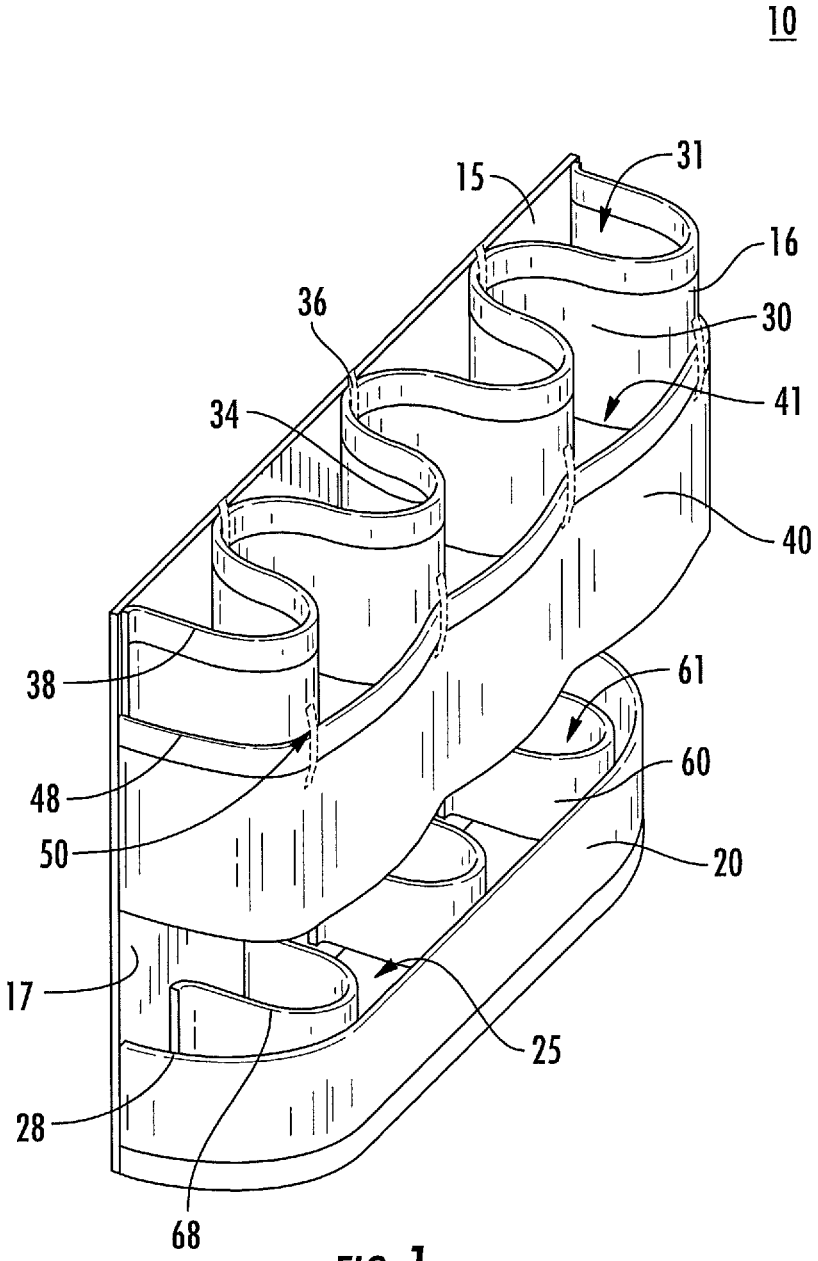
FIG. 1 is a perspective view of a tool holder described herein.

The description herein is directed to a tool holder, which can facilitate a worker's efficiency and organization on a project. The tool holder is configured to hold a variety of tools for easy storage, organization, transport and/or access when working on a project. Aspects of the invention will be explained in connection with a tool holder adapted for use with screwdrivers, but the detailed description is intended only as exemplary. The tool holder can be adapted for use with a variety of other tools such as wrenches, pliers, other hand tools and power tools. Embodiments of the tool holder are shown in FIGS. 1-11, but the present invention is not limited to the illustrated structures or applications.

As shown in FIGS. 1-6, a tool holder 10 with a main panel 15 and plurality of sleeves 16 is described. The main panel 15 can be formed of flexible or rigid material. As used herein, the term "rigid" means capable of maintaining substantially the same shape, e.g. substantially planar, when the tool holder 10 is upright and/or when placed under loads typical of tool holders in use, e.g. 5 pounds, 10 pounds, 15 pounds, etc.

The main panel 15 can include a front side 17, and the plurality of sleeves 16 can extend from the front side 17 of the main panel 15. The sleeves 16 can be formed from first and second sleeve components 30, 40. The sleeve components 30, 40 can form openings 31, 41, such that a tool can be received through each opening 31, 41.

Figure 3:
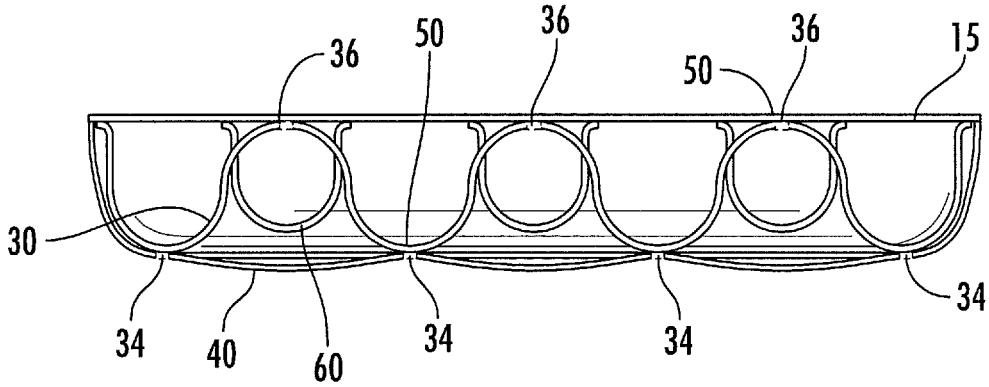
FIG. 3 is a top view of a tool holder described herein.
Figure 4:
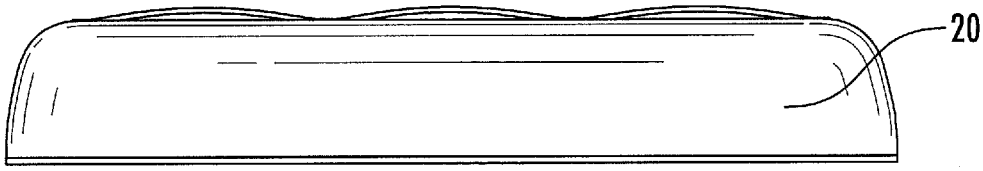
FIG. 4 is a bottom view of a tool holder described herein.

As shown in FIGS. 1 and 3, the plurality of sleeves 16 can include a first sleeve component 30 forming a plurality of peaks 34 and valleys 36. The peaks 34 and valleys 36 can be formed with respect to the main panel 15. For example, valleys 36 can include portions of the first sleeve component 30 that are most proximate to the main panel 15 and peaks 34 can include portions of the first sleeve component 30 that are least proximate to the main panel 15. The terms peaks and valleys are intended to include minor deviations from the locations described herein. As used herein, "proximate" is intended to include deviations of plus or minus 1 millimeter (mm), or plus or minus 5 mm, or plus or minus 10 mm, or plus or minus 15 mm.

Figure 7:
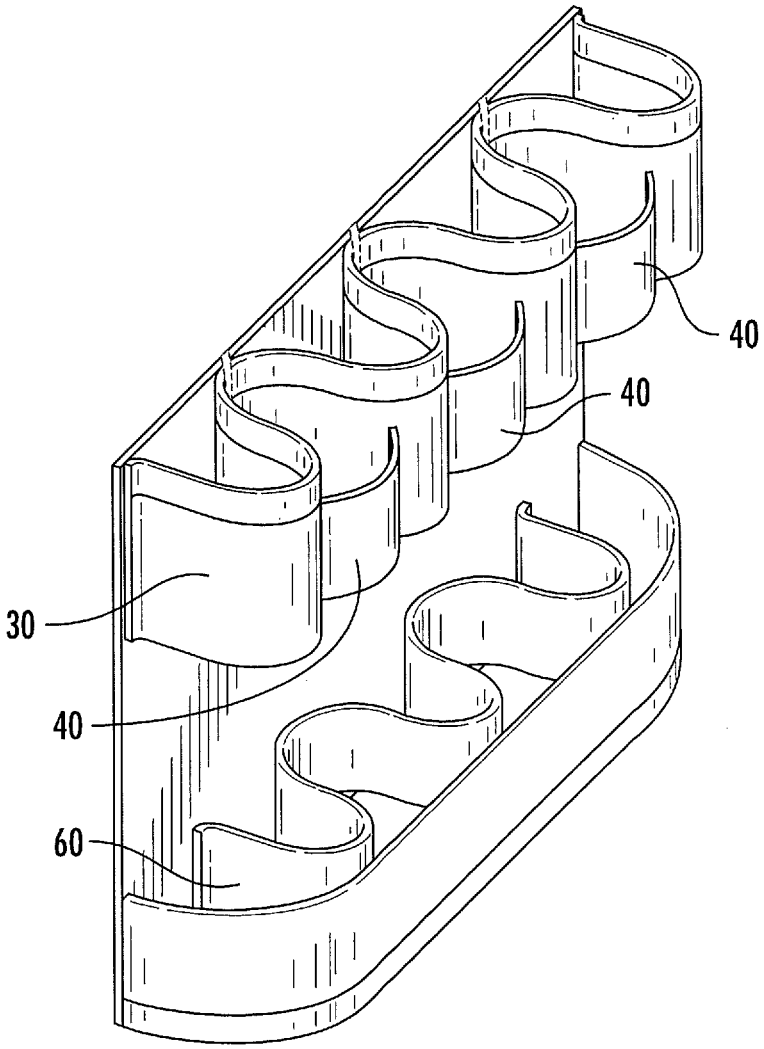
FIG. 7 is a perspective view of a tool holder described herein

Each of the sleeve components 30, 40 can be continuous or discrete. For example, as shown in FIG. 1, the first sleeve component 30 can include a continuous sinusoidal strip of material forming a series of peaks 34 and valleys 36 between the ends. In other arrangements, the first sleeve component 30 can include a continuous triangular strip. The second sleeve component 40 can include a continuous strip of material, extending over a lower portion of the first sleeve component 30. In another arrangement, as shown in FIG. 7, the second sleeve component 40 can include multiple discrete strips of material.

The second sleeve component 40 can be coupled to the first sleeve component 30 at a plurality of coupling points 50. Exemplary methods of coupling can include, but are not limited to, stitching, adhesives, snaps, rivets, bindings, other appropriate fasteners, hook and loop fasteners, welding, soldering, casting, molding, and combinations thereof. For example, the first and second sleeve components 30, 40 can be coupled as a unitary molded plastic material.

As shown in FIGS. 1 and 3, at least one primary opening 31 can be formed between the main panel 15 and the first sleeve component 30 between adjacent valleys 36 of the first sleeve component 30. At least one secondary opening 41 can be formed between the second sleeve component 40 and the first sleeve component 30 between adjacent peaks 34 of the first sleeve component 30. Each of the openings 31, 41 can be configured for a tool, such as a screwdriver, to be received through the opening 31, 41 and retained in a substantially upright position in the tool holder 10. As shown in FIGS. 1 and 3, the at least one primary opening 31 and at least one secondary opening 41 can include multiple openings. The number of openings 31, 41 can vary based on the dimensions of the main panel 15 and/or the type and shape of tools to be accommodated.

As used herein, "coupling point" refers to any point, line, area, or region along which the components 30, 40 can be coupled. The coupling points 50 between the first sleeve component 30 and the second sleeve component 40 can be at any suitable locations. As shown in FIG. 1, the coupling points 50 can be positioned at the peaks 34 of the first sleeve component 30. The coupling points 50 can also be positioned at adjacent peaks 34.

In other arrangements, the coupling points 50 can be positioned between adjacent peaks 34 of the first sleeve component 30. As shown in FIG. 7, the coupling points 50 can include at least two points between adjacent peaks 34 of the first sleeve component 30. The tool holder 10 can include two coupling points 50 between adjacent peaks of the first sleeve component 30 to form a secondary opening 41 between each set of adjacent peaks 34. In other examples, a tool holder 10 can include more than two coupling points 50 between adjacent peaks 34 of the first sleeve component 30 to form more than one secondary opening 41 between each set of adjacent peaks 34.

The first sleeve component 30 can also be coupled to the main panel 15 in any suitable location by any of the coupling techniques described herein. For example, the valleys 36 of the first sleeve component 30 can be coupled to the front side 17 of the main panel 15 by stitching as shown in FIG. 1. In other examples, the first sleeve component 30 can be coupled to the main panel 15 as a unitary molded plastic material or via adhesive.

In other examples, the first sleeve component 30 can be secured in position by compression and friction. For example, the ends and/or peaks of the first sleeve component 30 can be restrained by compression and friction between the main panel 15 and second sleeve component 40. In such an arrangement, the first sleeve component 30 can, optionally, be removable.

The tool holder 10 can also include a pocket 20 extending from a lower end 19 of the main panel 15. The pocket 20 can define an inner cavity 25 for receiving a tool, e.g. a distal end of a tool. The pocket 20 and the plurality of sleeves 16 can be separated vertically by a distance adapted for receiving and storing a tool supported in the primary or secondary openings 31, 41. In one arrangement, the pocket 20 can be disposed below the plurality of sleeves 16 such that an end of a tool, such as a screwdriver, received through any of the above openings 31, 41 can be received in the inner cavity 25 of the pocket 20.

Figure 2:
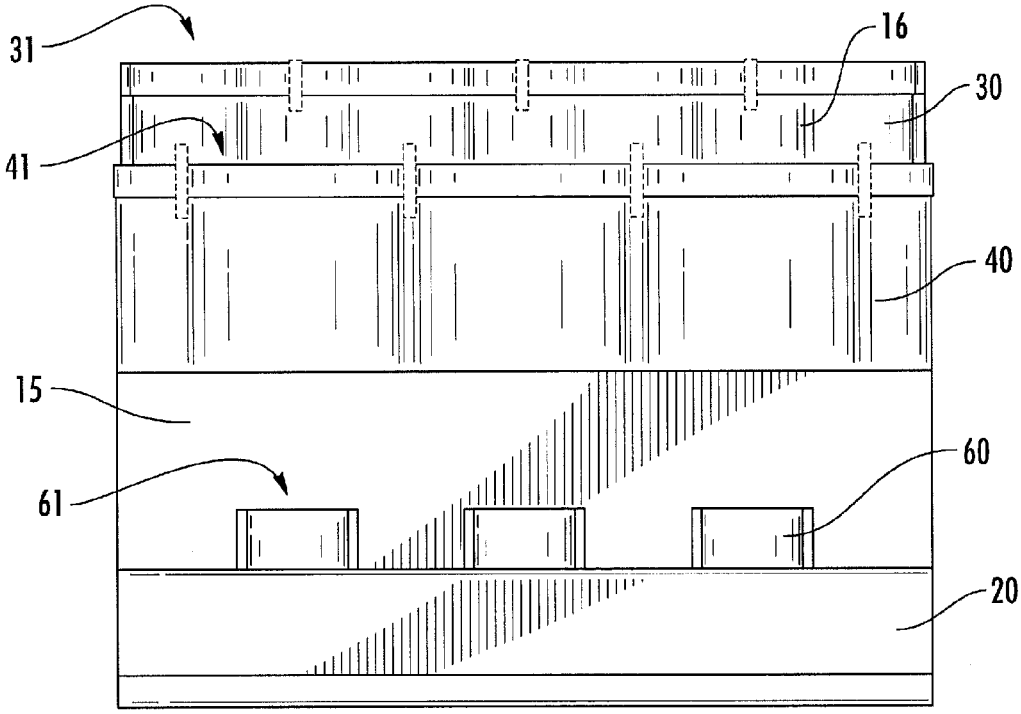
FIG. 2 is a front view of a tool holder described herein.

As used herein, "vertical" and "vertically" are used to refer to the vertical direction when the tool holder 10 is in an upright position, for example as shown in FIGS. 1 and 2. The terms vertical and vertically are intended to include minor deviations from the direction defined herein. For example, deviations of plus or minus 15 degrees, or plus or minus 10 degrees, or plus or minus 5 degrees.

Figure 5:
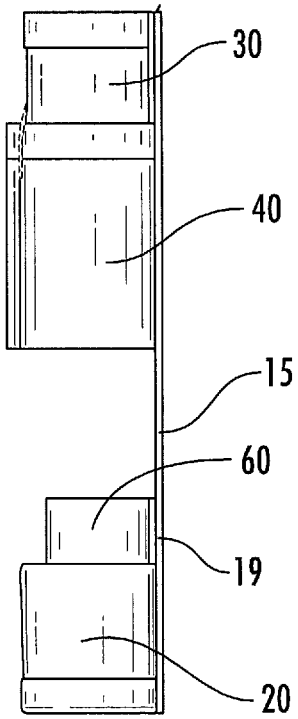
FIG. 5 is a side view of a tool holder described herein.
Figure 6:
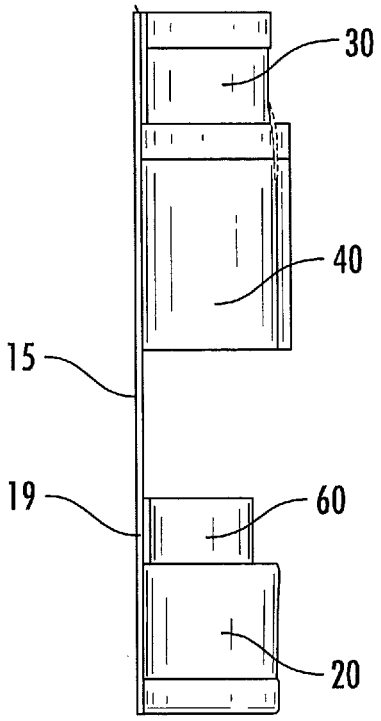
FIG. 6 is another side view of a tool holder described herein.
Figure 11:
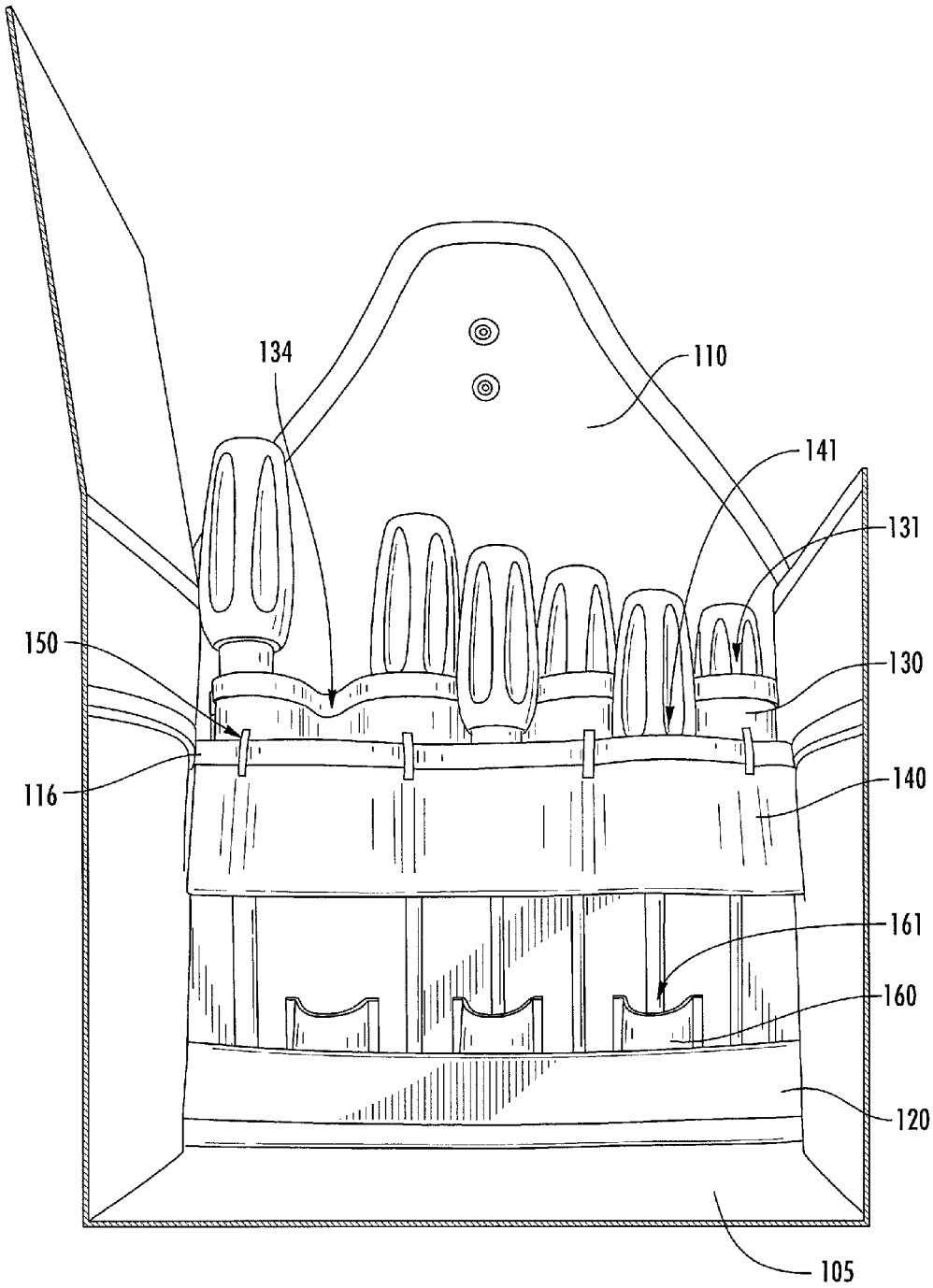
FIG. 11 is a cross sectional view of a sidewall of a tool bag described herein, taken along cut line 11-11 in FIG. 10.

The tool holder can also include a lower sleeve component 60 extending from the front side 17 of the main panel 15, and disposed below the plurality of sleeves 16 as shown in FIGS. 5 and 6. The lower sleeve component 60 can include at least one stabilizing opening 61 for receiving a tool. As shown in FIGS. 2 and 3, the stabilizing openings 61 can be in substantial vertical alignment with the secondary openings 41. The number of stabilizing openings 61 formed can equal the number of secondary openings 41 formed. In an exemplary application, as shown in FIG. 11, a tool such as a screwdriver can be received through the secondary opening 141 and into or through the corresponding stabilizing opening 161.

The lower sleeve component 60 can also be continuous or discrete. For example, as shown in FIG. 1, the lower sleeve component 60 can include discrete strips of material, each strip having with two ends and each end coupled to the main panel 15 to form a stabilizing opening 61. In another example as shown in FIG. 7, the lower sleeve component 60 can include a continuous sinusoidal or triangular strip of material forming peaks and valleys, and stabilizing openings 60 can be defined between adjacent peaks or adjacent valleys.

At least a portion of the lower sleeve component 60 can be disposed within the inner cavity 25 of the pocket 20. An upper edge 68 of the third sleeve component 60 can also be disposed above an upper edge 28 of the pocket 20 as shown in FIG. 1, the upper edge 68 of the third sleeve component 60 can be flush with the upper edge 28 of the pocket 20, or the upper edge 68 of the third sleeve component 60 can be disposed below the upper edge 28 of the pocket 20. In arrangements with the upper edge 68 flush with or disposed below the upper edge 28, the third sleeve component 60 in FIG. 1 would be cut off at the level of or below the upper edge 28 of the pocket 20.

Each of the sleeve components 30, 40 can also include an upper edge 38, 48. The upper edge 38 of the first sleeve component 30 can extend above the upper edge 48 of the second sleeve component 40 as shown in FIG. 1, the upper edge 38 of the first sleeve component 30 can be flush with the upper edge 48 of the second sleeve component 40, or the upper edge 38 of the first sleeve component 30 can be disposed below the upper edge 48 of the second sleeve component 40. In arrangements with the upper edge 38 flush with or disposed below the upper edge 48, the first sleeve component 30 in FIG. 1 would be cut off at the level of or below the upper edge 48 of the second sleeve component 40.

The plurality of sleeves 16, the lower sleeve component 60, and/or the pocket 20 can include any materials suitable for the tool holders described herein, such as fabric, e.g. nylon or canvas, plastic, leather, or combinations thereof, e.g. plastic reinforced fabric. Exemplary plastic reinforced fabric materials include those sold under the SPUNTUFF® trademark.

Figure 8:
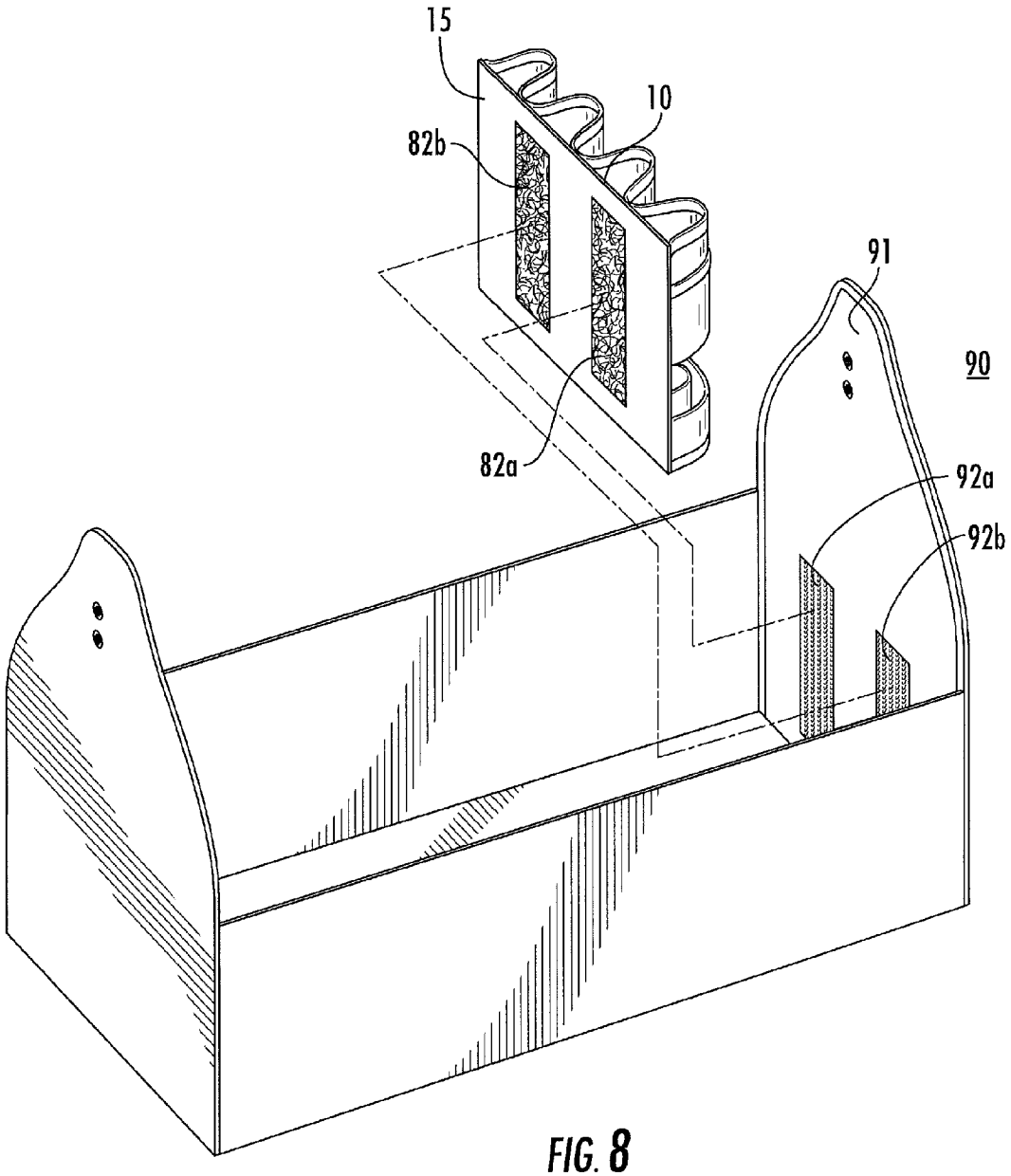
FIG. 8 is an exploded view of a tool bag described herein.

The tool holder 10 can also be configured to be removably or fixedly attached to a tool bag. For example, a tool holder 10 as described above can also include attachment elements such that the tool holder 10 can be removably attached to a side panel or lid panel of a tool bag. Removable attachment can be by any suitable means and exemplary attachment elements can include adhesives, fasteners such as snaps, buttons, zippers, hook and loop fasteners, tracks, tongue-and-groove, friction from adjacent side panels, and combinations thereof. For example as shown in FIG. 8, removable attachment elements 82*a*, 82*b* can be disposed on the tool holder 10, including on a back side of the main panel 15 of the tool holder 10. Corresponding removable attachment elements 92*a*, 92*b* can be disposed on a side panel 91 of a tool bag 90. The removable attachment elements 82*a*, 82*b* can comprise loops and the removable attachment elements 92*a*, 92*b* can comprise hooks, or vice versa.

Figure 9:
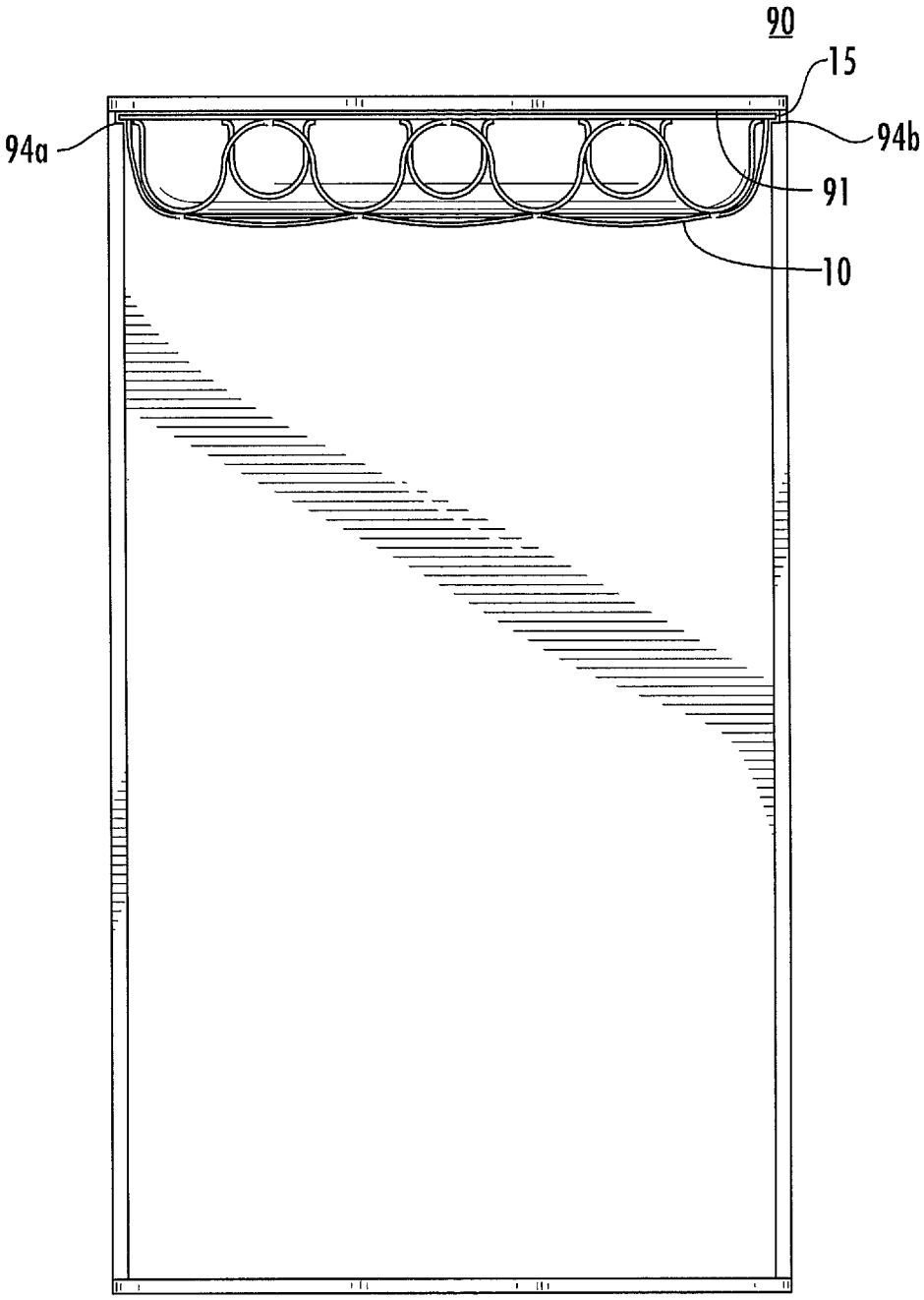
FIG. 9 is a top view of a tool bag described herein.

Removable attachment elements can also be disposed on either of the tool holder 10 or the tool bag 90. As shown in FIG. 9, removable attachment elements 94*a*, 94*b* can be included on the tool bag 90. The removable attachment elements 94*a*, 94*b* can comprise tracks on one or more of the sidewalls 91 of the tool bag 90, and the main panel 15 of the tool holder 10 can slidably engage with the tracks 94*a*, 94*b*. Tracks 94*a*, 94*b* can be integral in one or more sidewalls 91 as shown in FIG. 9, or can extend from a sidewall 91 including an end wall.

Figure 10:
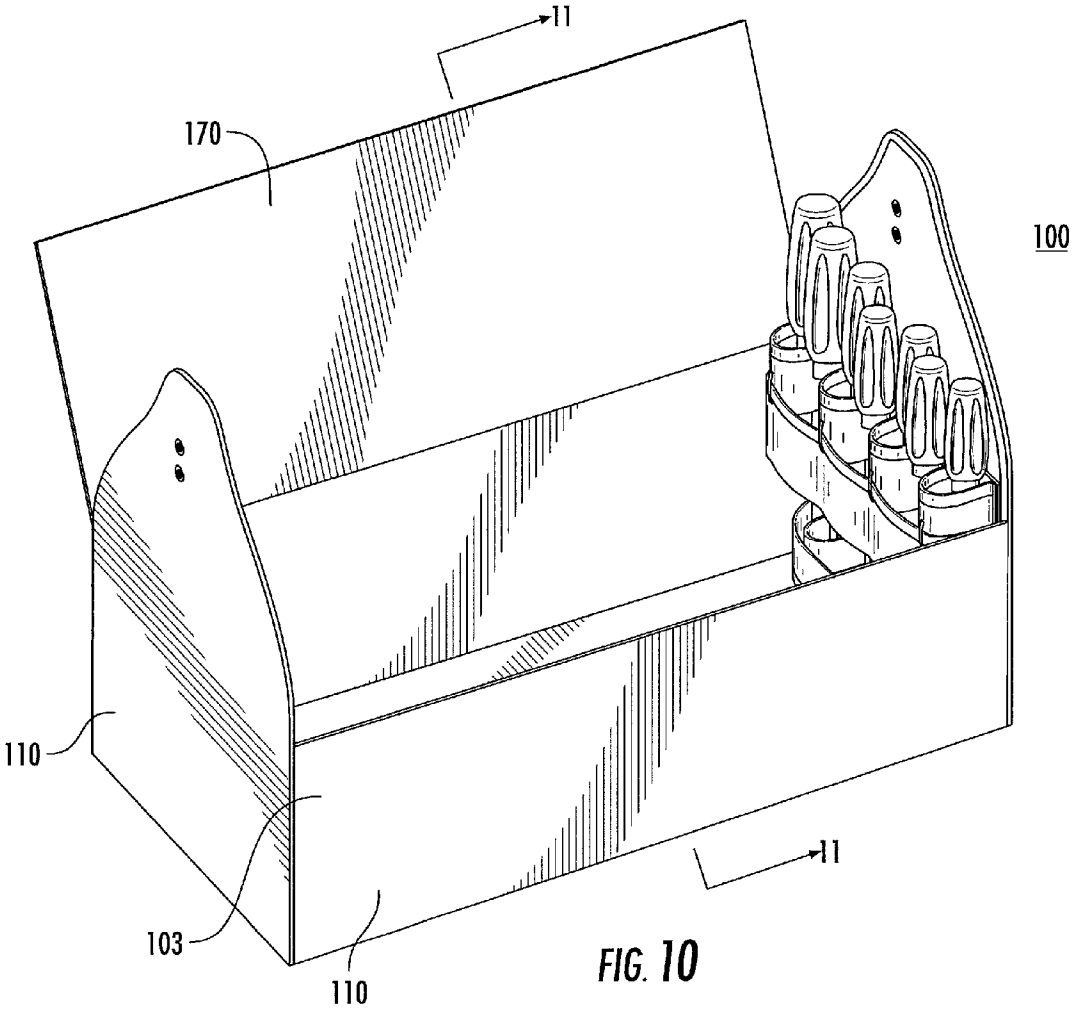
FIG. 10 is a perspective view of a tool bag described herein.

In another arrangement, the tool holder can be integrated with a tool bag body. As shown in FIGS. 10 and 11, a tool bag 100 having a tool holder 10 attached to a tool bag body 103 is also described herein. The tool bag body 103 can include an open topped storage volume formed from a bottom panel 105 and a plurality of side panels 110. Each of the plurality of side panels 110 of the tool bag body can include a front side.

At least one of the plurality of side panels 110 further comprises a plurality of sleeves 116 extending from the front side of the side panel 110. The plurality of sleeves 116 can be formed from first and second sleeve components 130, 140. The sleeve components 130, 140 can form openings 131, 141, such that a tool can be received through each opening 131, 141.

The first and second sleeve components 130, 140 can be continuous or discrete. The first sleeve component 130 can form a plurality of peaks 134 and valleys 136 and the second sleeve component 140 can be coupled to the first sleeve component 130 at a plurality of coupling points 150. At least one primary opening 131 can be formed between the side panel 110 and the first sleeve component 130 between adjacent valleys 136. At least one secondary opening 141 can be formed between the second sleeve component 140 and the first sleeve component 130 between adjacent peaks 134.

The bottom panel 105 and the plurality of sleeves 130, 140 can be separated vertically by a distance adapted for receiving and storing a tool supported in the primary or secondary openings 131, 141. In other arrangements, the tool bag 100 can also include a pocket 120 extending from a lower end of the front side of the side panel 110, and the pocket 120 and the plurality of sleeves 130, 140 can be separated vertically by a distance adapted for receiving and storing a tool supported in the primary or secondary openings 131, 141. The pocket 120 can be disposed above and/or in contact with the bottom panel 105. At least a portion of the pocket 120 can also be formed by at least a portion of the bottom wall 105.

The tool bag 100 can also include a lower sleeve component 160 extending from the front side of the side panel 110 and disposed below the plurality of sleeves 116. The lower sleeve component 160 can be continuous or discrete. The lower sleeve component 160 can include at least one stabilizing opening 161. The stabilizing openings 161 can be in substantial vertical alignment with the secondary openings 141, such that a tool can be received through a secondary opening 141 and into or through the corresponding stabilizing opening 161.

The tool holder can be integrated with the side panel 110 in any suitable position. As shown in FIG. 11, the front side of the plurality of side panels 110 can include an inner side of the plurality of side panels 110. In other arrangements, the front side of the plurality of side panels 110 can include an outer side of the plurality of side panels 110. As used herein, the terms "inner" and "outer" with respect to sides of the side panels refer to a side's proximity to the open topped storage volume. For example, the inner side can be the side of a side panel most proximate to the open topped storage volume and the outer side can be the side least proximate.

The tool bag 100 can also include a lid panel 170 attached to the tool bag body. The lid panel 170 can be attached by any method allowing the lid panel 170 to be opened or moved for access into the tool bag body 103. For example, the lid panel 170 can be removably attached, such as resting on at least a portion of the upper edges of the side panels, or fixedly attached, such as by pivotal attachment to a side panel.

A plurality of screwdrivers can be stored in the tool holder as demonstrated in FIG. 11, with the screwdrivers generally positioned upright and side by side. In this configuration, a set of screwdrivers can be easily and efficiently organized, stored and accessed by a user.

The foregoing is provided in the context of one possible application for a tool holder according to aspects of the invention. While the above description and figures are made in the context of a set of screwdrivers, it will be understood that the apparatus according to aspects of the invention can be readily applied to other tools as well, including a mixture of types of tools. Thus, it will of course be understood that the invention is not limited to the specific details described herein, which are given by way of example only, and that various modifications and alterations will be apparent to those skilled in the art and may be made without departing from the scope or spirit of this invention.

What is claimed is:

1. A tool holder, comprising:

a main panel having a front side; and a plurality of sleeves extending from the front side and forming openings, whereby a tool can be received through each opening, said plurality of sleeves comprising:

a first sleeve component forming a plurality of peaks and valleys;

a second sleeve component coupled to said first sleeve component at a plurality of coupling points;

at least one primary opening formed between said main panel and said first sleeve component between adjacent valleys; and at least one secondary opening formed between said second sleeve component and said first sleeve component between adjacent peaks;

a lower sleeve component extending from the front side of said main panel, said lower sleeve component comprising at least one stabilizing opening; and a pocket extending from a lower end of the front side of said main panel, said pocket having an inner cavity for receiving and stabilizing a tool supported by the plurality of sleeves;

wherein said pocket and said plurality of sleeves are separated vertically by a distance adapted for receiving and storing a tool and said inner cavity is in substantial vertical alignment with said at least one primary and at least one secondary openings;

wherein said at least one stabilizing opening is in substantial vertical alignment with said at least one secondary opening;

wherein said lower sleeve component is disposed below said plurality of sleeves; and wherein at least a portion of said lower sleeve component is disposed within said inner cavity of said pocket.

2. The tool holder according to claim 1, wherein said valleys of the first sleeve component are coupled to said front side of the main panel.

3. The tool holder according to claim 1, wherein said coupling points are positioned at or between adjacent peaks of said first sleeve component.

4. The tool holder according to claim 1, wherein said coupling points are positioned at the peaks of said first sleeve component.

5. The tool holder according to claim 1, wherein said coupling points comprise at least two points between adjacent peaks of said first sleeve component.

6. The tool holder according to claim 1, wherein an upper edge of said first sleeve component extends above an upper edge of said second sleeve component.

7. The tool holder according to claim 1, wherein an upper edge of the lower sleeve component is disposed above an upper edge of the pocket.

8. The tool holder according to claim 1, wherein said plurality of sleeves comprise materials selected from the group consisting of fabric, plastic, plastic-reinforced fabric, and combinations thereof.

9. A tool holder, comprising:

a main panel having a front side;

a plurality of sleeves extending from the front side and forming openings, whereby a tool can be received through each opening, said plurality of sleeves comprising:

a first sleeve component forming a plurality of peaks and valleys, a second sleeve component coupled to said first sleeve component at a plurality of coupling points, at least one primary opening formed between said main panel and said first sleeve component between adjacent valleys, and at least one secondary opening formed between said second sleeve component and said first sleeve component between adjacent peaks;

a lower sleeve component extending from the front side of said main panel and disposed below said plurality of sleeves; and a pocket extending from a lower end of the front side of said main panel, said pocket having an inner cavity for receiving a tool;

wherein said lower sleeve component comprises at least one stabilizing opening and said at least one stabilizing opening are in substantial vertical alignment with said at least one secondary opening; and wherein at least a portion of said lower sleeve component is disposed within said inner cavity of said pocket.

* * * * *